United States Patent [19]

Drummond

[11] 4,020,623

[45] May 3, 1977

[54] NOVEL TEXTILE PROCESS

[75] Inventor: Warren W. Drummond, Allison Park, Pa.

[73] Assignee: PPG Industries, Inc., Pittsburgh, Pa.

[22] Filed: Dec. 3, 1975

[21] Appl. No.: 637,346

[52] U.S. Cl. ..... 57/157 F; 57/140 G

[51] Int. Cl.[2] ..... D01H 7/92

[58] Field of Search ..... 57/157 F, 140 G, 34 B, 57/156; 28/62, 72.12; 68/DIG. 1; 34/23, 155

[56] References Cited

UNITED STATES PATENTS

| | | | |
|---|---|---|---|
| 2,526,775 | 10/1950 | Slayter et al. | 57/157 F |
| 3,009,309 | 11/1961 | Breen et al. | 57/156 X |
| 3,202,747 | 8/1965 | Soehngen | 57/34 B |

*Primary Examiner*—Richard C. Queisser

*Assistant Examiner*—Charles Gorenstein

*Attorney, Agent, or Firm*—Alan T. McDonald; John E. Curley

[57] ABSTRACT

A process for providing a dried textile yarn, glass fiber yarn in particular, is described in which a wet textile strand is passed through a zone of high fluid turbulence, a heating zone and wound rapidly on a spool. In the process as applied to glass fiber yarns, finished textile strands are provided on spools which are considerably larger than the finished bobbins normally used by textile weavers. The yarns are dried directly from the wet forming packages to a completely dried state thus eliminating the binder migration problems frequently encountered in the drying of fiber glass on forming packages.

13 Claims, 4 Drawing Figures

NOVEL TEXTILE PROCESS

BACKGROUND OF THE INVENTION

In the production of yarns or strands for textile use, it is common practice in the glass fiber industry to draw glass filaments from a molten glass source. This source is contained in a metallic container provided with a multiplicity of orifices or tips on the bottom through which the molten glass flows to form the glass fiber filaments. These filaments are passed over an applicator which applies a binder to the filaments. The filaments are then gathered into strands which are wound at high speed on a forming tube placed on a rotating collet to form a forming package containing the fiber glass strand. These packages are wet as formed and are typically dried in ovens prior to transferring the strand to a twist frame so that the strand can be twisted and placed on a bobbin.

The binders normally employed for textile strands are starch based materials. This binder is burned off the strand after it is woven into cloth and leaves little or no residue on the cloth so that the cloth can then be treated with the various finishes used by the weaver with uniform effect on the cloth.

It has been a particularly bothersome problem in the glass fiber manufacturing art in drying forming packages having starch sized strands thereon that migration of the binder or size occurs often. This migration leads to an uneven distribution of binder to the layers of strand on the forming package and thus nonuniform strand. Further, the twist frame operation is costly and bobbins presently used carry small quantities of strand thereon which require the user to make frequent bobbin changes in the loom operations used to produce cloth.

THE PRESENT INVENTION

In accordance with the present invention a process is provided which permits the formation of strand from a wet forming package which is free of binder migration problems. Further, the strands are provided on packages for use by weavers which are considerably larger than the bobbins currently employed and the strand itself is rounded and well consolidated even though it has not been subjected to the conventional twist frame operations.

Thus, glass fiber strand from a wet forming package is introduced into a zone of high fluid turbulence. In this zone the strand is agitated by a circumferential flow of fluid which is passed around the zone in a direction perpendicular to the flow of the strand through the zone. This treatment is conducted preferably with air as the fluid. The strand is passed from this zone into an elongated drying zone wherein the moisture is removed and using a horizontal traversing guide eye the dried strand is collected on a spool.

DETAILED DESCRIPTION OF THE INVENTION

The invention will be more readily understood by reference to the accompanying drawing in which.

Figures 1, 2, 3, 4:
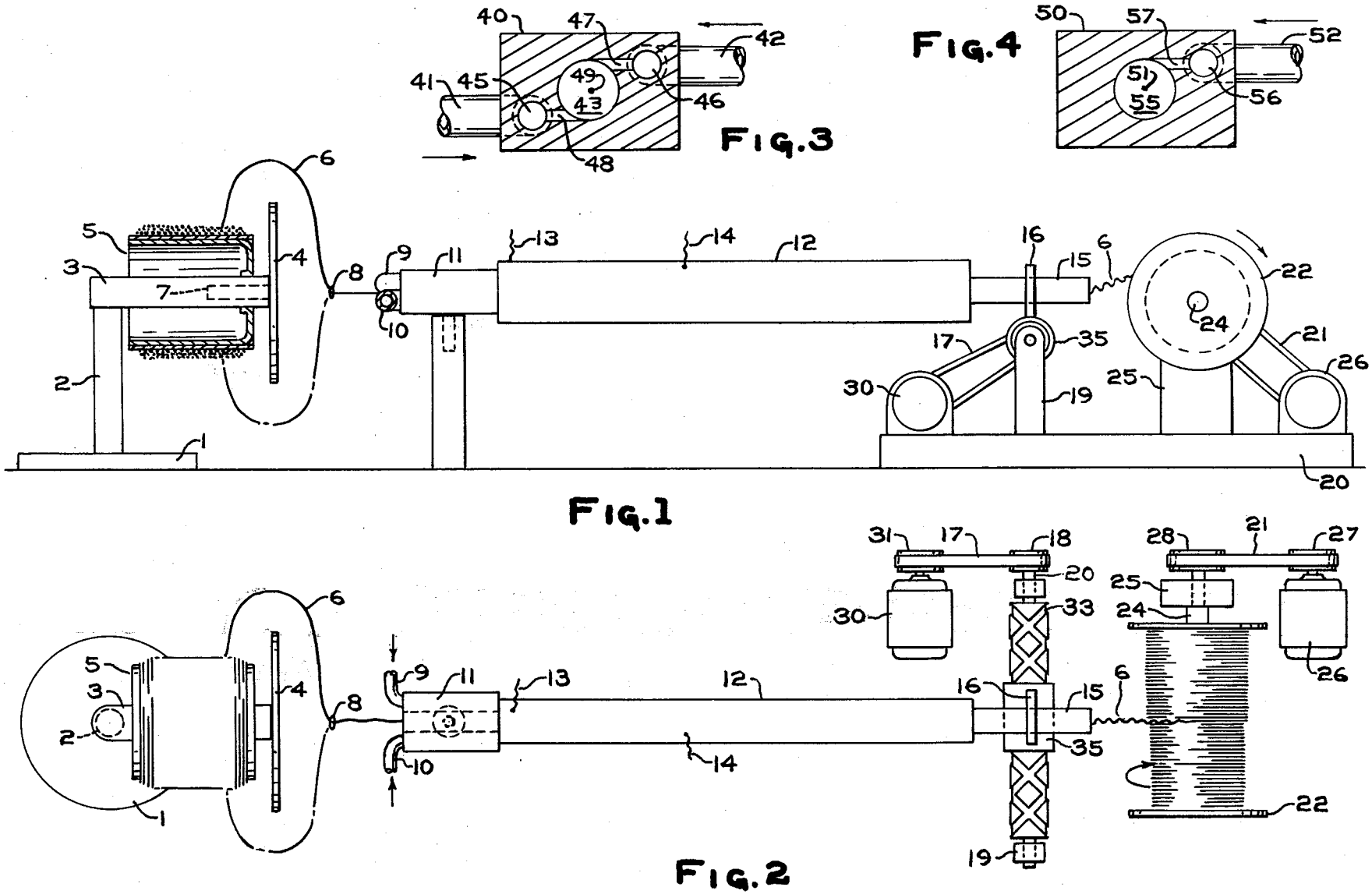
FIG. 1 is a side elevational diagrammatic illustration of the apparatus used in the instant process.
FIG. 2 is a top plan view of the apparatus of FIG. 2.
FIG. 3 is a cross-section of the device used in FIGS. 1 and 2 to create a zone of fluid turbulence.
FIG. 4 is a cross section of a device which may be used in lieu of the device of FIG. 3 to create a zone of fluid turbulence.

Turning to the drawings and to FIGS. 1 and 2 in particular, there is shown a glass fiber strand forming package 5. The package 5 is supported on a tube 3 which is mounted on stand 2 which is supported by the base or floor 1. A round plate 4 having a central pin 7 which is received on the interior of tube 3 is provided in a spaced relationship from the package 5. The diameter of the plate 4 exceeds that of the package 5 considerably and during the operation of the process forces the strand 6 removed from the package 5 to balloon out over it thus preventing the strand from snagging or sluffing off the package 5. The strand 6 is passed through a guide eye 8 after removal from the package 5 and is passed into the blower 11 which is provided with two fluid inlets 9 and 10.

The strand 6, after passing through the blowers 11, is passed through the elongated tube 12 which is provided on its interior with a heater, typically a resistance heater. The heater, now shown, is supplied with suitable energy from a power source through electrical leads 13 and 14. Temperatures of 425° C. to 650° C. are typically maintained in this zone. At strand speeds of 3,000 to 4,000 feet (914.4 to 1,219.2 meters) per minute, these temperatures adequately remove moisture from wet strand having above 9 percent moisture thereon.

The strand 6 is collected on a spool 22 by passing it through exit tube 15 from the tube 12. The tube 15 is traversed across the width of the spool 22. The traversing of the tube 15 is provided by the motor 30 which rotates pulley 31 and its belt 17. The belt 17 in turn rotates the shaft 20 which rotates the cam 33. The cam follower, not shown, rides on the cam tracks of cam 33 and is contained in the member 35. The spool 22 rotates through shaft 24 which is connected through pulley 28, belt 21 and pulley 27 to the rotating shaft of the motor 26.

In the operation of the apparatus shown in FIGS. 1 and 2, the blower 11 shown is the blower depicted in FIG. 3. As shown in FIG. 3 this blower 11 is constructed of a housing 40 having a longitudinal central bore or passageway 43. In this figure the strand passing through the bore 43 is illustrated as 49. Inlets 42 and 41 are provided for the introduction of fluid to chambers 46 and 45, respectively. These chambers are formed by boring two longitudinal, cylindrical holes through the walls of the housing 40 at opposite sides thereof. The holes are plugged at one end and are fitted to inlets 41 and 42 at the other end thus providing the chambers 45 and 46 on the inside of the housing 40. A plurality of inlets 48 are provided in fluid communication with the chamber 45 at one of their ends and the passageway 43 at the other of their ends. The inlets 48 are typically aigned in a straight line and there are usually four or more provided. Inlets 47 are similarly constructed to provide fluid communication through them from chamber 46 to the passageway 43. Again the inlets are usually four or more in number to provide fluid flow around the chamber 43 along a substantial length of it. This arrangement provides for the whirling fluid treatment of the strand 49 during its passage along substantially the entire length of the blower 11 during its passage therethrough when the device 40 is used as the blower 11 in the process described in FIGS. 1 and 2.

If desired, blower 11 can be the blower of FIG. 4 which is constructed of a housing 50 having a central passageway 55 provided therein which is open at the top and bottom of the housing 50. A chamber 56 is provided on the inside of housing 50 which is closed at one end and connected at the other end to a feed inlet line 52 for the passage of fluid into chamber 56. Chamber 56 is provided with a plurality of feed lines 57 which terminate at the wall of chamber 55 so that fluid entering chamber 56 can be passed into chamber 55. These lines 57 are arranged in a row along a substantial portion of the length of chamber 55 so that the strand 51 shown will be subjected to whirling fluid during its passage through the length of the blower 11 when the device of FIG. 4 is used as the blower 11 in conducting the process described in FIGS. 1 and 2.

The fluids utilized in the zone of turbulence in blower 11 are typically gases such as air, nitrogen, oxygen, carbon dioxide and other similar gases inert to the glass strand fed thereto. Steam may also be utilized. In the preferred embodiment of the instant invention air is utilized as the gas source.

The zone of turbulence is usually of small diameter and the central cavity of the zone is typically from about ⅛ inch to about ¾ inch (0.3175 to 1.91 centimeters) in diameter, preferably from ¼ inch to 178 inch (0.610 to 1.27 centimeters). Generally, the blower 11 is of a length sufficient to impart a false twist to the strand during its passage through the block and its central cavity. Lengths of 1 to 6 inches (2.54 to 15.24 centimeters) are typical with 1 to 3 inches (2.54 to 7.26 centimeters) being preferable for proper traversing of strand.

Using high pressure air to the zone of turbulence as a feed through the rows of inlets arranged in vertical alignment on the wall of the cavity and with the small diameter of the cavity defining a small circumference over which the air travels, air revolves around the circumference of the cavity at values of between about 20,000 to 1,070,000 revolutions per minute. Usually with cavities of ¼ to ½ inch (0.610 to 1.27 centimeters) in diameter the zone of turbulence has air flowing around it at 150,000 to 310,000 revolutions per minute.

The high speed of the air passing around the circumference of the cavity in the air turbulence zone in blower 11 passes around the strand 6 causing it to rotate in a cicumferential path imparting to the strand 6 a false twist since it is at low tension. The whirling action of the air striking the strand surface as it passes circumferentially to the strand 6 moving through the zone imparts a curvilinear wave form to the strand 6 as it exits the zone.

The process has been described with specific reference to textile strand made of glass fibers and containing starch based binders such as for example, the binder described in U.S. Pat. No. 3,227,192. This has been done for the general purposes of illustration and also to emphasize the particular utility of the instant process in producing this type of strand. It will be of course readily appreciated that the process can be readily employed on any other glass fiber strand having a binder which tends to migrate when the strand is dried on a forming package. This would include many binders on strands that are used in plastic and rubber reinforcement applications. Similarly, while the process has been particularly described as applied to glass fiber yarns, it can be practiced on any natural or synthetic strand which is wet and must be dried and twisted prior to use.

As will be appreciated from the above description of the novel process, a system is provided which provides finished textile strands in a dry state from a forming package feed supply. The package of strand resulting from the operation is larger than those normally used by textile weavers with its attendant advantages. The process also produces a package which because of its unique method of preparation eliminates a binder migration problem that has plagued the art for many years in the drying of textile yarn forming packages.

While the invention has been described with reference to certain specific illustrated embodiments, it is not intended that it be limited thereby except insofar as appears in the accompanying claims.

I claim:

1. A method for preparing a textile strand from a wet textile strand feed comprising feeding the wet textile strand into a zone of fluid turbulence, passing the strand through said zone in a given direction, contacting the strand in said zone with a fluid directed in a path circumferential to the strand and the long axis of the zone to thereby agitate the strand and apply a false twist thereto, and thereby produce a rounded and well-consolidated strand, passing the strand from the zone of turbulence through a drying zone operating at a temperature sufficient to remove a substantial portion of the moisture from the strand and collecting the strand after drying on a spool in successive layers having the strand in side-by-side relationship in each layer.

2. The method of claim 1 wherein the fluid fed to the zone of turbulence is a gaseous fluid.

3. The method of claim 1 wherein the fluid fed to the zone of turbulence is air.

4. A method of preparing a glass fiber strand from a wet package of fiber glass strand comprising feeding the wet strand from said package to a zone of fluid turbulence, passing the strand through said zone of fluid turbulence while simultaneously feeding a fluid to said zone, passing the fluid so fed to the zone of turbulence in a direction circumferential to the path of said strand and at a high velocity to thereby agitate the strand and impart a false twist thereto and to thereby form a rounded and well-consolidated strand, removing the strand so treated, drying the strand as it is removed in strand form and winding the strand on a spool in layers with the strand in side-by-side contact as wound in each layer.

5. The method of claim 4 wherein the fluid is a gaseous fluid.

6. The method of clam 4 wherein the fluid is air.

7. The method of claim 6 wherein the air flowing circumferentially in said zone is traveling at 20,000 to 1,070,000 revolutions per minute.

8. The method of claim 5 wherein the fluid flowing circumferentially in said zone is traveling at 20,000 to 1,070,000 revolutions per minute.

9. A method of treating glass fiber strand from a wet forming package of glass fiber strand comprising feeding the glass fiber strand from said wet forming package to a zone of fluid turbulence, passing the wet strand through said zone, continuously contacting said strand in said zone with a fluid flowing circumferentially around said zone at a high rate of speed to thereby agitate the strand and impart a false twist thereto during its passage through said zone, to thereby produce a rounded and well-consolidated strand, passing the strand from said fluid turbulence zone through an elongated drying zone, drying the strand as it passes through said drying zone and winding the dried strand on a spool in successive layers.

10. The method of claim 9 wherein the fluid is a gaseous fluid.

11. The method of claim 9 wherein the fluid is air.

12. The method of claim 9 wherein the fluid is air and the air is flowing circumferentially in said zone at 20,000 to 1,070,000 revolutions per minute.

13. The method of claim 9 wherein the fluid is air and the air is flowing circumferentially in said zone at 150,000 to 310,000 revolutions per minute.

* * * * *